US009422137B2

(12) United States Patent
Kearney

(10) Patent No.: US 9,422,137 B2
(45) Date of Patent: Aug. 23, 2016

(54) DEVICE AND METHOD FOR LIFTING AND LOWERING A LOAD

(71) Applicant: Joseph Francis Kearney, East Ballina (AU)

(72) Inventor: Joseph Francis Kearney, East Ballina (AU)

( * ) Notice: Subject to any disclaimer, the term of this patent is extended or adjusted under 35 U.S.C. 154(b) by 0 days.

(21) Appl. No.: 14/764,092

(22) PCT Filed: Feb. 3, 2014

(86) PCT No.: PCT/AU2014/000065

§ 371 (c)(1),
(2) Date: Jul. 28, 2015

(87) PCT Pub. No.: WO2014/121319

PCT Pub. Date: Aug. 14, 2014

(65) Prior Publication Data

US 2015/0360916 A1 Dec. 17, 2015

(30) Foreign Application Priority Data

Feb. 5, 2013 (AU) ..... 2013900356

(51) Int. Cl.
*B66C 1/34* (2006.01)
*F04D 29/60* (2006.01)
(Continued)

(52) U.S. Cl.
CPC ... *B66C 1/34* (2013.01); *B66C 1/36* (2013.01); *B66C 1/66* (2013.01); *F04D 29/606* (2013.01)

(58) Field of Classification Search
CPC ..... B66C 1/34; B66C 1/36; B66C 1/66; F04D 29/606; B63B 2027/165; F16B 45/02
USPC ..... 294/82.33, 75, 82.31, 82.3, 66.1, 66.2
See application file for complete search history.

(56) References Cited

U.S. PATENT DOCUMENTS 3,031,222 A * 4/1962 Stewart ..... B66C 1/66 294/110.1
3,311,401 A * 3/1967 Bacon ..... E04G 21/025 294/110.1

(Continued)

FOREIGN PATENT DOCUMENTS

FI 103783 B1 9/1999
GB 1498386 A 1/1978

(Continued)

OTHER PUBLICATIONS

International Search Report of the International Searching Authority, dated Feb. 26, 2014 of Application No. PCT/AU2014/000065 filed Feb. 3, 2014.

*Primary Examiner* — Gabriela Puig
(74) *Attorney, Agent, or Firm* — Sorell, Lenna & Schmidt, LLP

(57) ABSTRACT

There is a method and a device for lifting and lowering respectively a load, the load having a lifting loop attached to the load. The device comprising: a first member having means for attachment to a lifting device and means for attachment to the lifting loop of the load; a second member having means on the second member for automatically guiding the lifting loop to define a path for coupling and uncoupling of the lifting loop to and from the first member; a securing mechanism on the first member which automatically secures the lifting loop to the first member when the lifting loop engages the first member; and a release mechanism for releasing the securing mechanism to release the lifting loop from the first member.

15 Claims, 6 Drawing Sheets

(51) Int. Cl.
*B66C 1/66* (2006.01)
*B66C 1/36* (2006.01)

(56) References Cited

U.S. PATENT DOCUMENTS 3,428,356 A * 2/1969 Anderson ..... B66C 1/66
294/110.1
4,026,594 A 5/1977 Kumpulainen
4,609,219 A * 9/1986 Go ..... B66C 1/66
294/82.24

FOREIGN PATENT DOCUMENTS

GB 2336398 A 10/1999
SE 384840 B 5/1976

* cited by examiner

DEVICE AND METHOD FOR LIFTING AND LOWERING A LOAD

FIELD OF THE INVENTION

The invention relates generally to a method and a device for lifting and lowering respectively a load which preferably shall be moved to and from a space below the ground or the floor, under a water surface or similar spaces which are difficult to access. In particular the invention relates to submersible pumps and, more particularly, to an apparatus for connecting a lifting tackle to the lifting loop of a submersible pump.

BACKGROUND OF THE INVENTION

It should be noted that reference to the prior art herein is not to be taken as an acknowledgement that such prior art constitutes common general knowledge in the art.

The term "pump" is used hereinafter to refer to a device that moves fluids (liquids or gases), or sometimes slurries, by mechanical action. The term "submersible pump" is used hereinafter to refer to a device which has a hermetically sealed motor close-coupled to the pump body. The submersible pump includes both the pump and motor being submerged in the fluid to be pumped.

Submersible pumps are usually disposed in deep pits below the level of the liquid to be pumped which, in many cases, is sewage. The pumps are usually lowered into the pumping station along substantially vertical guides fixedly positioned within the pumping station so that the pump outlets may be properly aligned and connected to the outlet pipes of the pumping station without using screws or other manual connecting mechanisms. The pumps are usually lifted from the pumping station by the connection of a hook, wire and winch on a crane truck, directly to the top of the pump. A wire or chain may also be attached to the top of the pump as a backup system, for instance when the well cannot be pumped out and there is no other reasonable way to connect the usual line. These chains typically stretch from the top of the pump and attach to a point close to the top of the pumping station in order to be attached to a lifting device such as a crane. However, it is usually standard practice and required that the well be pumped out before retrieval of the pump begins.

The primary disadvantage of the chain being permanently attached to the pump is that it is more than likely that the wire or chain will be subject to corrosion and or to fouling caused by sludge or solid particles in particular when used for sewerage pumps. Secondly, the use of the extant chain in the lifting process means the crane boom must be significantly higher to cope with the extra chain length. It could also be problematic when used in deep pumping stations where the cost of wires and chains for each and every pump disposed therein can be considerable.

In order to overcome this problem a loop or ring was attached to the top of the pump and with the use of a releasable hook attached to the end of crane cable the pump was lifted out of the pumping station. This method also had a number of disadvantages in particular when used in deep pumping stations. Under current practice, the well is firstly pumped empty. In order to hook the loop or ring onto the pump the driver of the crane, usually assisted by another crew member, then manually guides the hook towards the loop on the exposed pump. The essential difficulty in this task is guiding a free-swivelling hook into a very small, non-standard aperture in, critically, the correct orientation. This method is both troublesome, inherently risky and time consuming.

Moreover, the operator is often subjected to unsafe conditions. Thus, accidents or the threat of accidents occur from time to time which can cause considerable disabilities for the operator. Usually it is a question of fingers or hands getting pinched between the hook and the couple; an operator's finger and hands can be injured or even completely severed. At times injuries to other parts of the body may occur as a result of the fact that the operator stays within the range of movement of the hook where he can be hit by hooks moving in an uncontrolled manner.

Potentially the highest risk of personal injury and or serious and costly damage to the equipment comes from an insecure hook-up of the pump. If the connection fails and the pump drops back into the well, there is an instantaneous emission (splash) of remnant sewage from the bottom of the well which could contact the operators, and severe damage to the pump and associated infrastructure. The sudden release of the load on the lifting wire turns the wire and hook into a lethal projectile.

A typical scenario would be where a sewerage pump is located in a pumping station which is smelly, dirty, often in the dark, and located in a confined space some two to three meters below the ground level or working plane. Under these conditions the workplace involves a number of risks to personnel. As described above the normal practice involves one person operating the crane with a line and hook mechanism, and another person guiding a swivelling hook onto a loop or ring affixed to the top of the submersible pump.

Clearly it would be advantageous if a connecting device could be devised that helped to at least ameliorate some of the shortcomings described above. In particular, it would be beneficial for a lifting device which improves on these deficiencies in particular in improving the safety and labour required to lift and lower a load from a space below the ground or the floor, possibly below a water surface or similar spaces which are difficult to access.

STATEMENT OF THE INVENTION

According to a first aspect, the present invention provides a device for lifting and lowering a load, said load having a lifting loop attached to said load, the device comprising: a first member having means for attachment to a lifting device and means for attachment to the lifting loop of said load; a second member having means on said second member for automatically guiding said lifting loop to define a path for coupling and uncoupling of said lifting loop to and from said first member; a securing mechanism on said first member which automatically secures said lifting loop to said first member when said lifting loop engages said first member; and a release mechanism for releasing the securing mechanism to release the lifting loop from the first member.

Preferably, the lifting device may be an overhead lifting device, wherein said first member is releasably suspended from said overhead lifting device in order to lift said load.

The first member may have a connection means comprising an aperture for receiving a hook suspended from the overhead lifting device. Alternatively, the first member may have a connection means comprising a shackle attached to an aperture in said first member, the shackle being suspended from a chain which is attached to the overhead lifting device.

Preferably, the device may be adapted to rotate about an axis coaxially aligned with the chain of the overhead lifting device when the means on said second member comes into contact with the lifting loop to guide the lifting loop into contact with said first member to automatically couple said first member to said lifting loop.

The second member may be bell shaped with an open mouth at a first end and an opening at a second end through which the lifting loop passes to couple said lifting loop to said first member. The second member may further comprise a raised lip located on an inner surface of said second member and extending in an arc from said first end to said second end, wherein as the device is lowered and the lifting loop comes in contact with said lip the second member is rotated about said coaxial axis to automatically align and guide the lifting loop into contact with said first member. The lip may be shaped such that it is formed by two concave sides extending upwardly from the inner surface of the second member to form a raised line extending from the first end to the second end. The raised line formed between the first and second end may be formed in an arc, wherein the arc has a raised centre section located between said first and second end of said second member.

Preferably, the securing mechanism may comprise a releasably secured pivoted hook which automatically engages the lifting loop when the lifting loop is aligned in contact with the first member for coupling the lifting loop to the lifting device. The securing mechanism may further comprise a locking means comprising a pivotal pin member for engaging and locking the pivoted hook once the pivoted hook is engaged with the lifting loop.

Preferably, the release mechanism may comprise a release pin pivotally attached to the first member, wherein the release pin has a first end attached to the pivotal pin member and a second end attached to a release means, whereby when said release means is activated the pivotal pin member is rotated away from the pivotal hook to allow the hook to release the lifting loop and removing the load from the lifting device.

Preferably, the release means may be manually operated and comprises a rope means attached to an aperture in the second end of the release pin, whereby when said rope means is pulled the pivotal pin member is rotated away from the pivotal hook to allow the hook to release the lifting loop and removing the load from the lifting device.

Preferably, the rope means may comprise a metallic cable. Alternatively, the rope means may comprise a non-metallic cable.

Alternatively, the release means may be remotely operated and may comprise a disengaging means within said first member and responsive to a signal from a remote location for actuating a linear actuator to rotate the pivotal pin member away from the pivotal hook to allow the hook to release the lifting loop and removing the load from the lifting device. The linear actuator may be electrically operated and is responsive to a disengaging signal detected by a radio receiver within said first member.

Alternatively, the remotely operated release means may be actuated by hydraulic or pneumatic means for actuating the linear actuator to rotate the pivotal pin member away from the pivotal hook to allow the hook to release the lifting loop and removing the load from the lifting device.

Preferably, at least one camera may be attached to the first or second member, the lifting device, or the load to be lifted, wherein the at least one camera may be used for directing the connection of the lifting device and the lifting loop by a remote operator viewing the area covered by the at least one camera.

Preferably, at least one light may be used for illuminating the connection of the lifting device and the lifting loop.

Preferably, a load measuring device may be connected between the lifting device and the device for lifting and lowering the load for monitoring the load weight.

Preferably, a feedback system may provide an indication of the status and position of the pivoting hook in relation to the lifting loop. The feedback system may comprise a proximity sensor attached to the pivoting hook for detecting and monitoring the attachment of the first member to the lifting loop. The proximity sensor may be a sonar sensor.

Preferably, the device may comprise any one or more of a gas detection sensor, a turbidity sensor or a depth measurement sensor.

Preferably, the device for lifting and lowering a load may be manufactured from an intrinsically safe, anti-sparking material. The device for lifting and lowering a load may be coated with a corrosion resistant paint for use in undersea or mining applications.

Preferably, the device may further comprise a self-cleaning system used to clean both the device for lifting and lowering the load and the lifting hook. The self-cleaning system may comprise a loop clearing device to remove any foreign materials from the lifting loop. The loop clearing device may be a mechanical clearing means. The self-cleaning system may comprise a high pressure cleaning jet or high pressure cleaning hose.

Preferably, the device may further comprise a self-inflation means attached to the device for lifting and lowering a load to provide a further means of raising the load. The self-inflation means may be gas powered.

Preferably, the load may be a submersible pump, and said device for lifting and lowering the submersible pump may be lowered into a pumping station for engagement with the lifting loop of the submersible pump. The submersible pump may be located at a level below a working plane towards the bottom of the pumping station.

Preferably, the submersible pump may be a sewerage pump.

In accordance with a further aspect, the present invention provides a device for automatically coupling and uncoupling an overhead lifting device to a load having a lifting loop, the device comprising: a first member having means for attachment to a lifting device and means for attachment to the lifting loop of said load; a second member having means on said second member for automatically guiding said lifting loop to define a path for coupling and uncoupling of said lifting loop to and from said first member; a grip and release mechanism for automatically coupling to the first member for load-lifting purposes and for automatically uncoupling from the first member for load release purposes; and wherein the first member comprises a pivoting pin member that causes operation of the grip and release mechanism; and the device being such that the release part of the grip and release mechanism is operated by the weight of the load.

In accordance with a still further aspect, the present invention provides a method of lifting a load having a lifting loop and located in a pumping station at a level below a working plane, comprising the steps of: i) attaching a lifting device to an overhead crane; ii) lowering the lifting device connected to the overhead crane, said lifting device comprising a first member having means for attachment to the crane and means for attachment to the lifting loop of the load, and a second member having means on said second member for automatically guiding said lifting loop to define a path for coupling and uncoupling of said lifting loop to and from said first member; iii) engaging the lifting loop with the means on the second member wherein the second member rotates about an axis coaxially aligned with a lifting chain of the crane such that the lifting loop is guided to automatically couple with said first member; iv) securing the lifting loop to the lifting device; and v) operating the crane to raise the load.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

DETAILED DESCRIPTION OF THE PREFERRED EMBODIMENTS

The following description, given by way of example only, is described in order to provide a more precise understanding of the subject matter of a preferred embodiment or embodiments.

Figure 1:
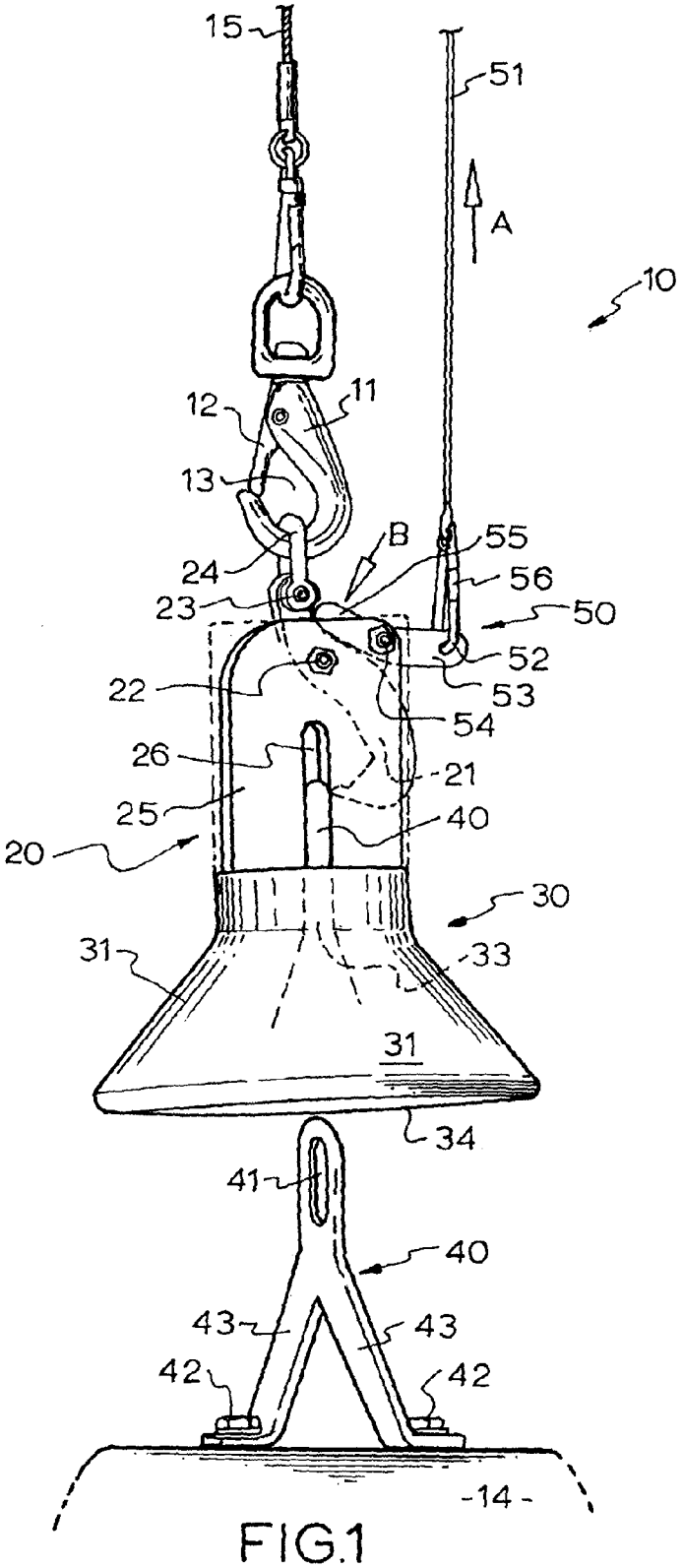
FIG. 1 illustrates a connecting device in accordance with an embodiment of the present invention.

FIG. 1 illustrates a lifting device 10 for lifting a load 14 in accordance with an embodiment of the present invention. The load 14 could be any load but for illustrating the use of the present device 10 is described in relation to a submersible pump 14 for use in pumping sewage from a pumping station 66. However it should be understood that the present invention is not limited to only this particular use. For example, underground water pumping stations could also utilise the present invention for removing and installing underwater pumps. The device could also be useful in any situation or environment which is hostile to human operation, for example, extreme heat, cold, gaseous atmospheres, confined spaces, difficult access or in a location where dangerous animals may exist. Submersible pumps 14 are usually disposed in deep pits or pumping stations 66 and below the level of the liquid to be pumped which, in this case, is sewerage 67. The pump 14 is lowered into the pumping station 66 along substantially vertical guides 65 (see FIG. 2) fixedly positioned within the pumping station 66 so that the pump outlets may be properly aligned and connected to the outlet pipes of the pumping station 66.

The lifting device 10 consists of two components, a top plate assembly 20 and a guiding member 30. The design of the underside or inner surface 32 shape of the guiding member 30 allows the top plate assembly 20 and hook 21 to automatically align itself to a bespoke or any standard shaped ring or hook 40 fixed to a submersible pump 14. FIG. 1 shows the loop 40 attached to the top of a pump 14 by fixing elements 42. The loop 40 has two arms 43 extending upwardly from the pump 14 which meet at a pre-determined distance raised above the pump 14 to form a ring or eye 41. It is the ring or eye 41 which is automatically aligned in the top plate assembly 20 and to which the hook 21 passes through.

Figure 2:
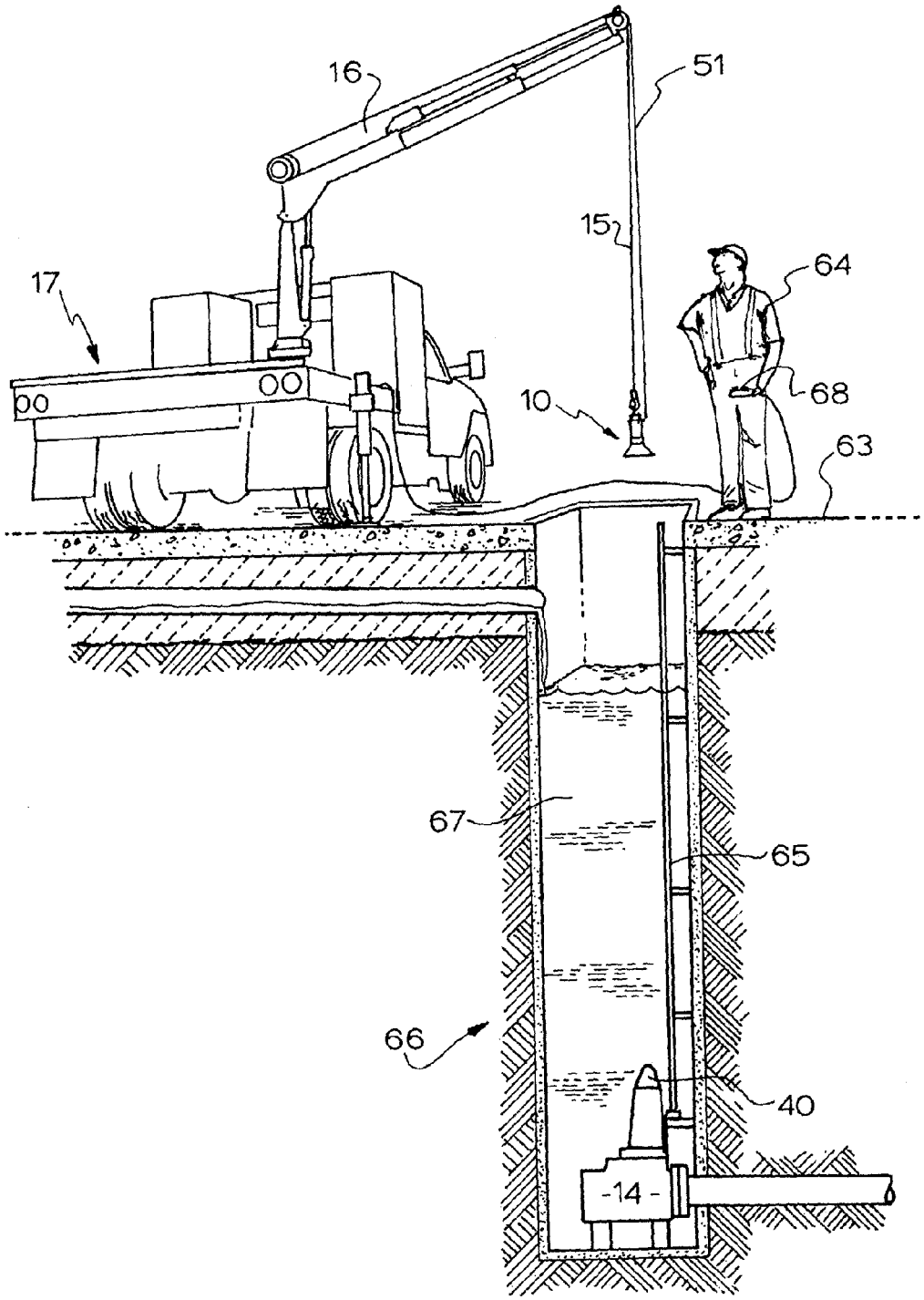
FIG. 2 shows the connecting device of FIG. 1 in use attached to the end of a crane to be lowered into a pumping station to remove a pump.
Figure 3:
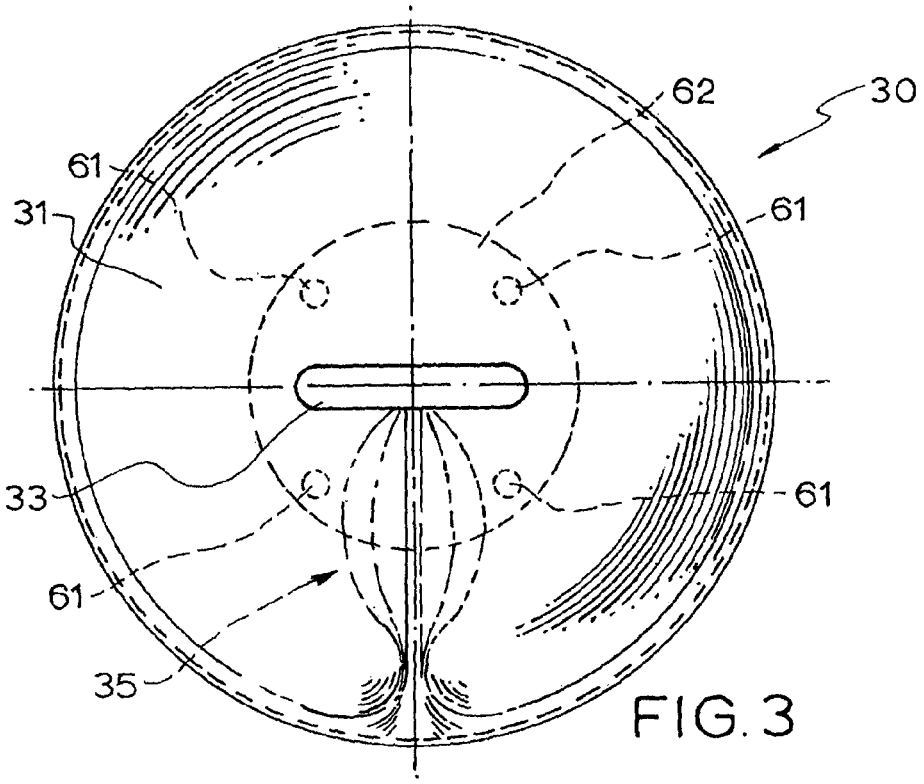
FIG. 3 shows a bottom view of the connecting device of FIG. 1.
Figure 4:
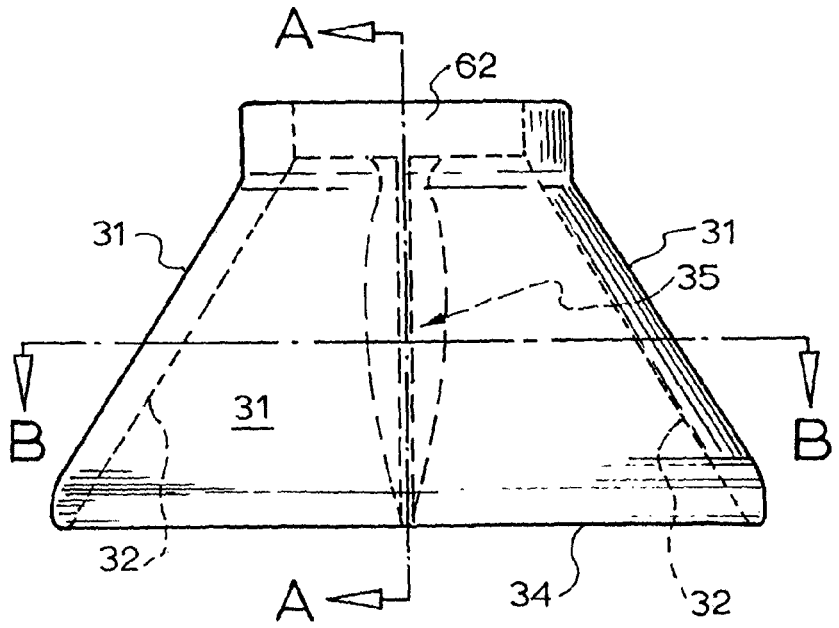
FIG. 4 show a front plan view of the connecting device of FIG. 1 with the lifting and locking mechanism removed for clarity.
Figure 5:
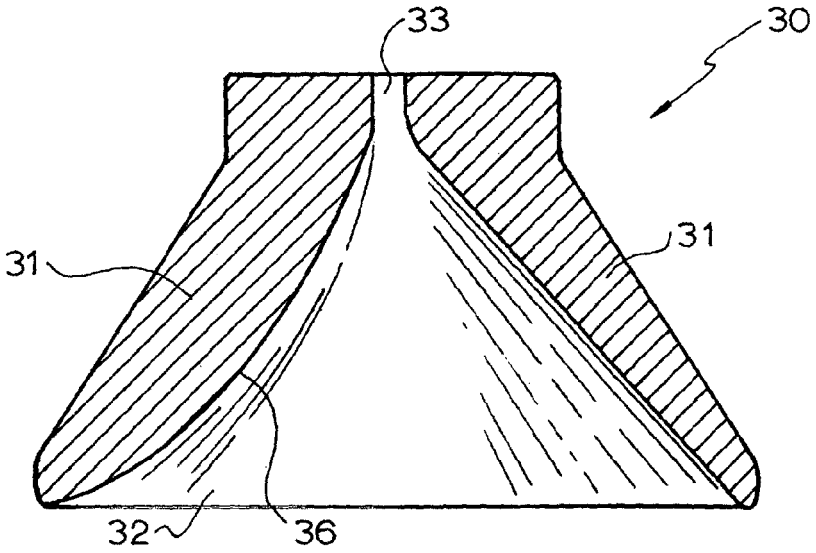
FIG. 5 is a sectional view taken along the line A-A of FIG. 4.
Figure 6:
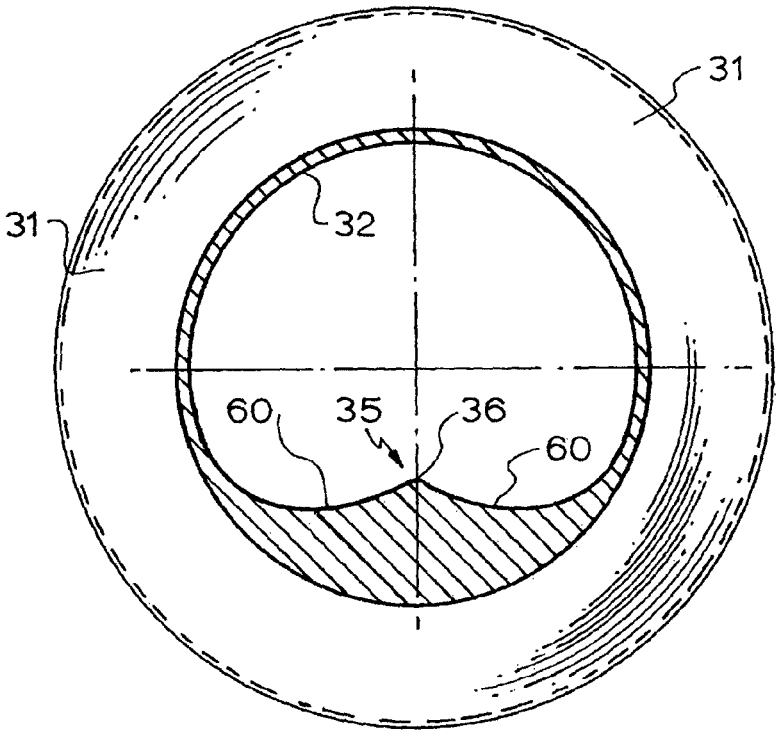
FIG. 6 is a sectional view taken along the line B-B of FIG. 4.
Figure 7:
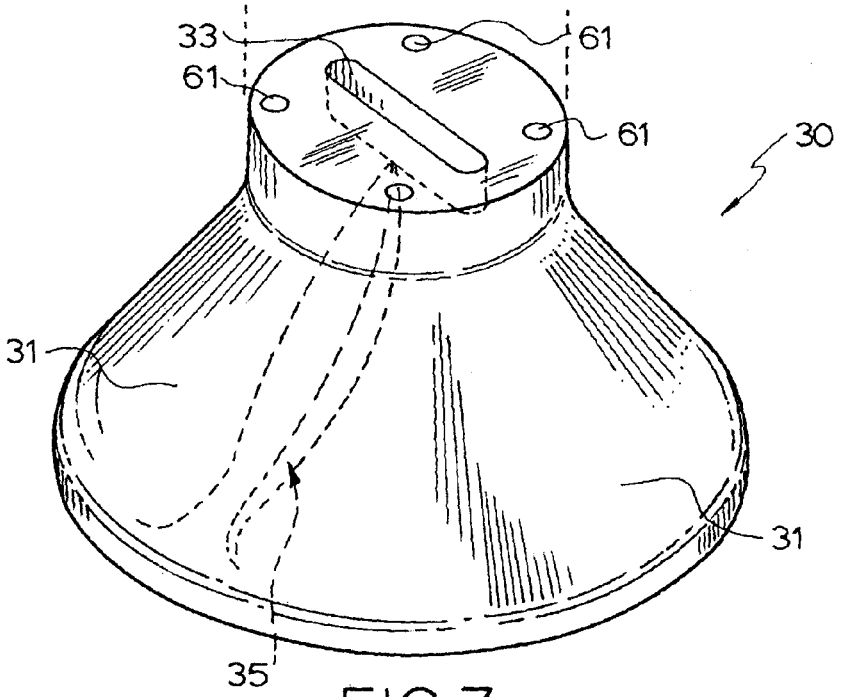
FIG. 7 shows a three dimensional from above of the connecting device of FIG. 1 with the lifting and locking mechanism removed for clarity.
Figure 8:
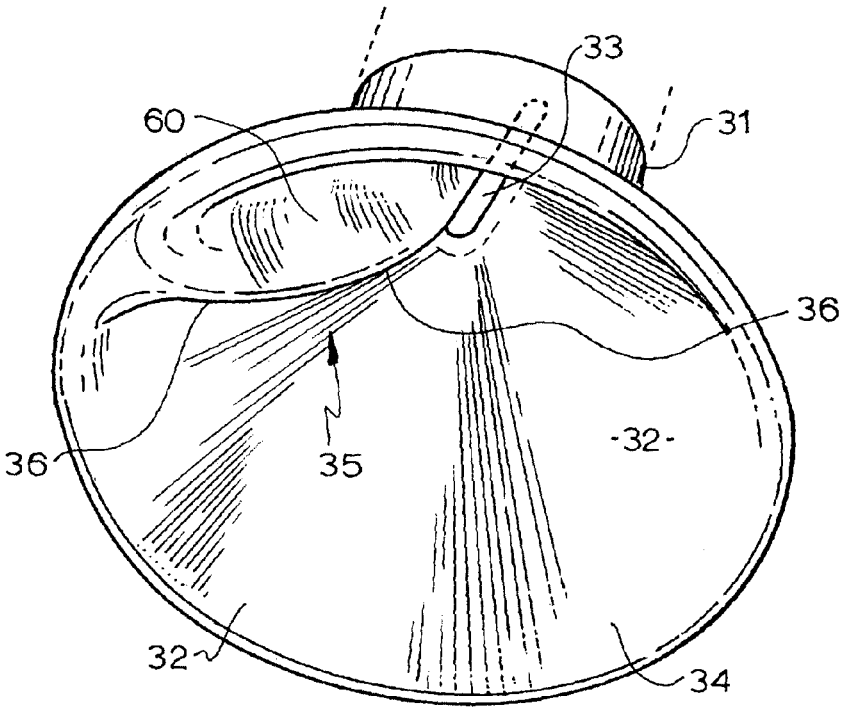
FIG. 8 shows a three dimensional view from below of the connecting device of FIG. 1 with the lifting and locking mechanism removed for clarity.

The lifting device 10 is typically suspended from a crane 16 by a chain member 15. In FIG. 2 the crane is attached to a vehicle or truck 17. The crane 16 could be attached to any suitable vehicle to lift a pump 14 out of a pumping station 66 or could be a stand-alone crane or any portable crane unit. Provided the crane is suitable for lifting a pump 14 safely out of a pumping station 66.

The crane 16 has a chain or rope 15 suspended from the crane 16 and terminating in a hook 11 which is attached to the lifting device 10. The hook 11 has a safety latch 12 and a throat opening 13 which receives a shackle 24 which is pivotally connected to the top of the hook 21 of the lifting device 10. The shackle 24, also known as a gyve, is typically a U-shaped piece of metal secured with a clevis pin or bolt 23 across the opening. Alternatively the shackle 24 may be a hinged metal loop secured with a quick-release locking pin mechanism. Shackles are used as a connecting link in all manner of rigging systems for industrial cranes. In a further alternative the crane chain 15 may be attached directly to the lifting device 10.

In FIG. 1 the shackle 24 is pivotally connected to the top of the hook 21. The hook 21 of the top plate assembly 20 is pivoted to the body 25 at a first pivot 22. The hook 21 is able to pivot between a closed and secured position in which the hook 21 is engaged with the ring or eye 41 of the pump loop 40 and an open position in which the hook 21 releases the eye 41 of the pump loop 40 and the pump 14.

While the hook 21 is in the closed or engaged position a locking member or pin 55 maintains the hook 21 in this position until the release mechanism 50 is actuated to release the hook 21 and the load or pump 14. In FIG. 1 the release mechanism consists of an actuator arm 53 which is pivotally connected to the locking, member or pin 55 at pivot point 54 on the body 25 of the top plate assembly 20. A release rope or cord 51 is attached to an aperture 52 located at one end of the release arm 53. The release rope or cord 51 may simply be looped through the aperture 52 or may be attached to a shackle 56 which is passed through the aperture 52 to secure the rope 51 to the release arm 53. When the rope 51 is pulled in the direction indicated by arrow A the locking member or pin 55 moves to the position indicated by arrow B which allows the hook 21 to pivot about pivot point 22 to release the pump loop 40.

The release rope or cord 51 is either a metallic or non-metallic cable of sufficient strength to allow the release mechanism 50 to be actuated.

The release arm 53 can only be actuated when the load 14 attached to the hook 21 is either set down on the ground or located in the mounting position within the pumping station 66. The release mechanism 50 cannot be actuated because the weight of the load and the combined forces of gravity maintain the locking member 55 in the locked or secured position. Once the weight is removed the release mechanism 50 is able to be actuated top release the hook 21 from the loop 40.

As described above the release mechanism 50 is a mechanical process using a rope 51 to release the hook 21 when the rope is pulled in the direction of arrow A. It should be understood that a number of other options exist for the release mechanism and the invention is not limited to only a purely mechanical process. Other methods including remote activation are described below.

In accordance with a further embodiment the release mechanism 50 is a remotely actuated disengaging means located within the top plate assembly 20 and responsive to a signal from a remote control 68 for actuating a linear actuator (not shown). The liner actuator is displaceable between a locked position in which the linear actuator secures the hook 21 and an unlocked position in which the hook 21 is able to rotate way from the lifting loop 40 and releases the load or pump 14.

A number of options also exist for the control of the actuation of the linear actuator. A control system is basically a device, or set of devices to manage, command, direct or regulate the behavior of other device(s) or system(s). There are a number of different types of control systems, with many variations and combinations. As described above the term "control system" may be applied to the essentially manual controls that allow an operator, for example, to lock and unlock the hook 21. Another option which may be used is an automatic sequential control system which may trigger a mechanical actuator to perform the task of controlling the hook 21. For example various electric, pneumatic or hydraulic transducers may control the linear actuator to automatically and/or remotely secure and release the hook 21 of the lifting device 10.

In the case of linear feedback systems, a control loop, including sensors, control algorithms and actuators, is arranged in such a fashion as to try to regulate a variable at a setpoint or reference value. Control systems that include some sensing of the results they are trying to achieve are making use of feedback and so can, to some extent, adapt to varying circumstances.

The actuator may be electrically operated and responsive to a disengaging signal detected by a radio receiver located within the top plate assembly. Or alternatively the actuator may be either hydraulically controlled or pneumatically controlled as described above. For example, the remotely operated release means is actuated by hydraulic or pneumatic means to actuate the linear actuator to rotate the locking member 55 away from the pivotal hook 21 to allow the hook 21 to release the lifting loop 40 and removing the load or pump 14 from the lifting device 10.

In order to automatically locate the loop 40 in the opening 33 of the guiding member 30 a raised lip 35 is located on the inner surface 32. As shown in FIGS. 3 to 8 the guiding member 30 consists of an outer surface 31 and inner surface 32 forming a frusto-conical shape with an opening 33 located at one end and a mouth 34 located at the opposite end. On the inner surface 32 the lip 35 is formed by two concave sides 60 extending upwardly from the inner surface 32 to a point at which the two concave sides 60 form a raised edge 36 which extends from the opening 33 at one end to the mouth 34 at an opposite end. The raised edge 36 is formed in the shape of an arc with a centre point raised slightly above a point located at either end of the raised edge 36.

The guiding member 30 is attached to the top plate assembly 20 by fasteners secured in threaded holes 61 in the top of the guiding member 30. The top plate assembly is located within a recess 62 in the top end of the guiding member 30 and secured to the guiding member 30 by the fasteners.

The opening 33 is formed as a longitudinally extending slot which is shaped to receive the upper end of the pump loop 40 which contains the ring or eye 41. To secure the pump 14 to the lifting device 10 the hook 21 of the top plate assembly 20 passes through the ring or eye 41 to secure the loop 40 for raising and lowering pump 14. The other end of the guiding member 30 is formed as an open mouth 34 which is shaped to initially allow a user or operator 64 to easily locate the lifting device 10 in the approximate location of the pump loop 40.

It is the design of the raised, lip 35 which provides a surface upon which the pump loop 40 comes into contact with and is automatically guided towards engagement with the hook 21 of the top plate assembly 20. This will be further described with reference to FIGS. 9 to 11 below.

Figure 9:
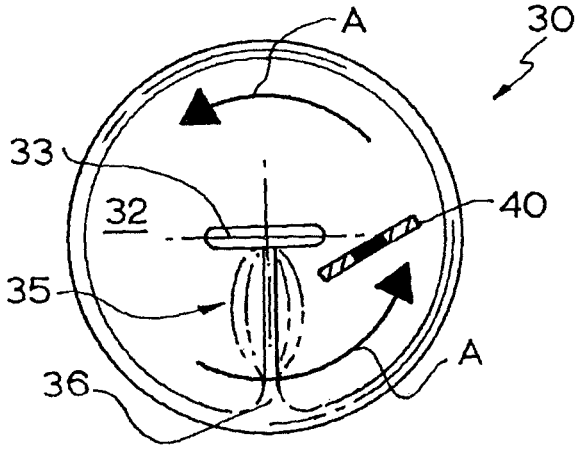
FIGS. 9 to 11 graphically illustrate the connecting device in use as the device rotates and automatically locates the loop or ring.
Figure 10:
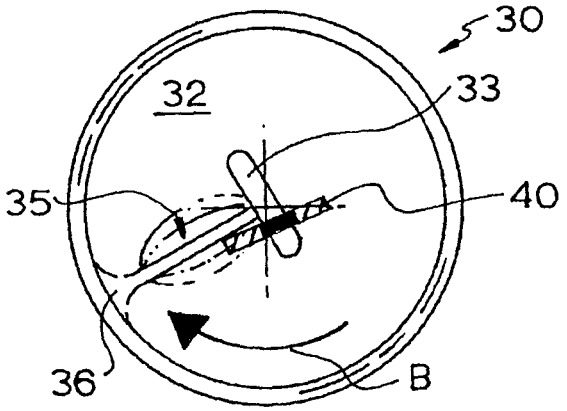

In FIG. 9 the guiding member 30 is being lowered towards the approximate location of the pump loop 40. As the guiding member 30 is lowered and under the weight of gravity the guiding member 30 rotates in an anti-clockwise rotation as indicated by arrows A. As shown in FIG. 10 as the guiding member 30 is lowered further the raised lip 35 comes into contact with the pump loop 40 and at this point the direction of rotation is reversed as indicated by arrow B. The guiding member 30 is now rotating in a clockwise direction and is moving to guide the pump loop 40 towards the opening or slot 33. As also shown in FIG. 10 the raised lip 35 is in contact with the pump loop 40.

Figure 11:
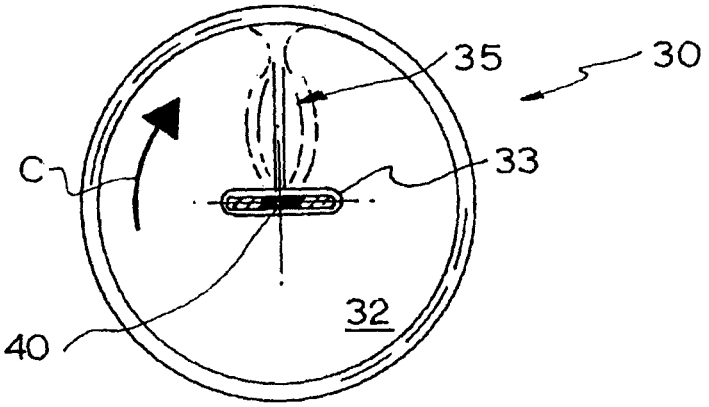

Finally, as illustrated in FIG. 11 the guiding member 30 continues to rotate in a clockwise direction as indicated by arrow C until the pump loop 40 is aligned with the opening or slot 33. At this point the guiding member 30 is lowered so that the pump loop 40 passes through the opening or slot 33 and into engagement with the hook 21 of the top plate assembly 20. The hook 21 then locks into engagement with the ring or eye 41 of the pump loop 40 and the locking member 55 secures the hook 21 in place to safely raise the pump 14.

In use and as illustrated in FIG. 2, an operator 64 would locate his vehicle 17 in a location such that when his vehicle mounted portable crane 16 is deployed it is able to reach over an access hole of the pumping station 66. The operator 64 then uses a remote control 68 which enables the operator to remotely and autonomously carry out all operations in safely removing and/or replacing a submersible pump 14. The submersible pump 14 is usually located below the ground plane or level 63 a distance extending into the pumping station 66. In most cases the submersible pump 14 is located beneath the level of sewage 67 and a few meters below the ground level 63. The submersible pump 14 is typically mounted on a pump guide or carriage 65.

In order to remove a pump or load 14 from its mounted position the operator attaches a lifting device 10 to the end of the crane 16. In this example use the lifting device release mechanism 50 is a cable 51 which is also activated and controlled by the crane 16 and the remote control 68. As described above in relation to FIGS. 9 to 11 the lifting device 10 is lowered into the pumping station 66 and aimed at a position which the operator 64 approximates as to the location of the pump loop 40. As the lifting device is lowered it is free to rotate in any direction or may not rotate at all. However to explain simply with the use of FIGS. 9 to 11 the lifting device as lowered in this instance is rotating in the direction of arrow A. Until the guiding member 30 comes into contact with the pump loop 40 it will continue to rotate in the direction of arrow A. At this point the direction of rotation is reversed and the pump loop 40 is automatically guided into the correct position for securing the load 14 to the lifting device 10. Once secured the pump or load 14 is raised by the crane 16 and removed from the pumping station for maintenance and/or replacement.

Due to the nature of the secure connection between the pump 14 and the lifting device 10 any work can be carried out with the lifting device still attached to the pump 14. However in most cases the pump is removed from the lifting device 10 until it is required to be lowered back into the pumping station 66. Once the pump or load 14 has been repaired or maintenance has been competed the operator 64 simply re-attaches the lifting device 10 to the pump loop 40 and lowers the pump 14 back into the pumping station as guided by the pump guide or carriage 65. Once the lifting device 10 is secured to the pump loop 40 the connection cannot be removed until the weight of the device being lifted in this case the pump 14 is seated in position in the pumping station 66 and the weight and therefore the tension has been removed from the crane cable 15. At this point the release mechanism 50 is actuated and the lifting device 10 is released from the pump loop 40 and the lifting device 10 can then be removed from the pumping station 66.

As can be imagined a number of options and different component parts may be interchanged or added to the present lifting device to assist in the removal of a load 14 from a position below the ground level 63.

By way of example only some of those options are included in the following text however it should be understood that the present invention is in no way limited to only those devices or components.

A camera may be positioned on the lifting device 10 in order to monitor the connection between the hook 21 and the pump loop 40. This allows the operator 64 to remotely operate and view the area covered by the camera. The camera may be mounted on the top plate assembly 20, the guiding member 30 or to a position located towards the end of the crane chain 15. The camera is particularly useful when the submersible pump 14 is located beneath the level of sewerage 67 in the pumping station 66 or when there is no clear view of the pump loop 40. In order to provide lighting in the pumping station 66 a light may also be attached to the lifting device 10 to help illuminate the connection and improve the picture received by the camera. Any type of camera or light may be used for example, the camera may be a wireless camera and the light may be an infrared LED light.

In order to determine the weight of the load 14 being raised and lowered by the crane 16, a load cell may be placed between the end of the chain 15 and the lifting device 10. Typically the load cell is a transducer that is used to convert a force into an electrical signal. This conversion is indirect and happens in two stages. Through a mechanical arrangement, the force being sensed deforms a strain gauge. The strain gauge measures the deformation (strain) as an electrical signal, because the strain changes the effective electrical resistance of the wire. A load cell usually consists of four strain gauges in a Wheatstone bridge configuration. The electrical signal output is typically in the order of a few millivolts and requires amplification by an instrumentation amplifier before it can be used. The output of the transducer can be scaled to calculate the force applied to the transducer. The use of the load cell ensures that the safe lifting weight of the crane 16 is not exceeded.

As described above the control system used for actuating the release mechanism can also be used to provide feedback as to the position of the connection. For example, as the hook 21 pivots around the pivot point 22 the position of the hook 21 can be monitored and is fed back to the operator to closely monitor the connection process. The use of feedback is typically a process in which information about the past or the present influences the same phenomenon in the present or future. As part of a chain of cause-and-effect that forms a circuit or loop, the event is said to "feedback" into itself. For example a feedback signal is the measurement of the actual level of the parameter of interest, in this case the actual position of the hook 21 is monitored using a proximity sensor which can be used to detect and monitor the position of the hook 21 in relation to the pump loop 40.

The proximity sensor is a sensor able to detect the presence of nearby objects without any physical contact. For example, a sonar sensor or ultrasonic sensors which work on a principle similar to radar or sonar which evaluate attributes of a target by interpreting the echoes from radio or sound waves respectively.

Any number of sensors may be used in conjunction with the lifting device 10 and in particular, due to the nature of use of the lifting device in sewerage pumping stations 66 any of a gas detection sensor, a turbidity sensor or a depth measurement sensor may also be incorporated in the lifting device 10.

Furthermore, due to the nature of the environment in which the lifting device 10 is used, the material from which the device 10 is manufactured must be both an intrinsically safe, anti-sparking material and is coated with a corrosion resistant paint.

Also, the lifting device 10 includes the ability to be self-cleaning or includes apparatus which provides for self-cleaning. This can be either a high pressure cleaning jet or as high pressure cleaning hose which can be incorporated with the lifting device 10. The cleaning device can be used to clean the actual lifting device itself or may be incorporated to also clean the pumping station 66 as the lifting device 10 is raised and lowered into and out of the pumping station 66. Also due to the nature of use in a sewerage pumping station 66 there is also a problem with the pump loop 40 becoming fouled with foreign material and therefore the lifting device 10 may also include a mechanical loop clearing device.

Should for some reason the cable for attaching to the crane was to break then a flotation device fitted to the lifting device 10 could be inflated to float the lifting device to the surface of the sewerage pumping station for recovery of the lifting device 10. In order to inflate the device 10 a gas tank would also be incorporated with the flotation device.

ADVANTAGES

Basically, the device has been designed in order to overcome the difficulty of manually guiding a hook onto the ring atop the pump and attaching it securely for safe lifting out of the confined space for servicing and repair.

The design of the underside shape of the device allows the hook to automatically align itself to a bespoke or any standard shaped ring fixed to a submersible pump. The action of the hook is assisted by its own weight under gravity to find the correct orientation of the ring and dock securely in one motion. When the ring is properly located in the hook, the device secures the ring so that it cannot slip off the hook and the pump can then be lifted safely. When returning and lowering the pump back into the pumping station, the device can be easily released remotely and therefore maintaining safe work practices at all stages of the operation.

The device has been designed to greatly reduce the effort involved in retrieving submersible pumps from their standard operating location at varying distances below ground level. With this device one operator can guide the hook to the ring from above the open sewer well. The design of the underside of the device means the operator need only roughly align the hook vertically above the ring, then lower the line. The action of gravity combined with the shape of the underside curve of the device automatically aligns the hook onto the loop or ring and secures it for safe lifting.

Furthermore, the pump is held securely in both raising and lowering due to the design of the release. The release can only be operated when the weight of the load is removed from the hook. For example, when the pump is sitting in position in the sewerage station.

VARIATIONS

It will be realized that the foregoing has been given by way of illustrative example only and that all other modifications and variations as would be apparent to persons skilled in the art are deemed to fall within the broad scope and ambit of the invention as herein set forth.

In the specification the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

The invention claimed is:

1. A device for lifting and lowering a load, said load having a lifting loop attached thereto, the device comprising:

a guiding member including an inner surface converging upwardly from a mouth toward an opening for passage of the lifting loop therethrough;

an attachment assembly fast with the guiding member and arranged to engage the lifting loop upon the lifting loop proceeding through the opening;

an inwardly protruding lip extending from the inner surface of the guiding member and positioned to interact with the lifting loop to thereby align the lifting loop with the opening.

2. A device as claimed in claim 1, adapted to rotate about an axis coaxially aligned with a chain of an overhead lifting device when the lip interacts with the lifting loop to thereby align the lifting loop with the opening.

3. A device as claimed in claim 2, wherein said guiding member is bell shaped with the mouth at a first end and the opening at a second end.

4. A device as claimed in claim 3, wherein said raised lip extends in an arc from said first end to said second end, wherein interaction of the lip with the lifting loop rotates the guiding member about said coaxial axis for alignment of the lifting loop with the opening.

5. A device as claimed in claim 4, wherein said lip is shaped such that it is formed by two concave sides extending upwardly from the inner surface of the guiding member to form a raised line extending from the first end to the second end.

6. A device as claimed in claim 4, wherein the raised line formed between the first and second end is formed in an arc, wherein the arc has a raised centre section located between said first and second end of said guiding member.

7. A device as claimed in claim 1, wherein the attachment assembly comprises a releasably secured pivoted hook which automatically engages the lifting loop when the lifting loop is aligned and brought into contact with the attachment assembly.

8. A device as claimed in claim 7, wherein the attachment assembly further comprises a pivotal pin member for engaging and locking the pivoted hook once the pivoted hook is engaged with the lifting loop.

9. A device as claimed in claim 1, including a release mechanism comprising a pivoting release pin arranged to allow the hook to release the lifting loop and remove the load from the lifting device.

10. A device as claimed in claim 9, wherein the release pin is manually operated by a line attached thereto.

11. A device as claimed in claim 1, manufactured from an anti-sparking material.

12. A device as claimed in claim 11, coated with a corrosion resistant paint for use in undersea or mining applications.

13. A device as claimed in claim 1, wherein said load is a submersible pump.

14. A device for automatically coupling and uncoupling an overhead lifting device to a load having a lifting loop, the device comprising:

a first member having means for attachment to a lifting device and means for attachment to the lifting loop of said load;

a second member having an inwardly protruding lip formed thereon for automatically guiding said lifting loop for coupling and uncoupling to and from said first member;

a grip and release mechanism for automatically coupling to the first member for load-lifting purposes and for automatically uncoupling from the first member for load release purposes; and wherein the first member comprises a pivoting pin member that causes operation of the grip and release mechanism; and the device being such that the release part of the grip and release mechanism is operated by the weight of the load.

15. A method of lifting a load having a lifting loop and located in a pumping station at a level below a working plane, comprising the steps of:

i) attaching a lifting device to an overhead crane;

ii) lowering the lifting device connected to the overhead crane, said lifting device comprising a first member having means for attachment to the crane and means for attachment to the lifting loop of the load, and a second member having an inwardly protruding lip formed thereon for automatically guiding said lifting loop to define a path for coupling and uncoupling of said lifting loop to and from said first member;

iii) engaging the lifting loop with the inwardly protruding lip wherein the second member rotates about an axis coaxially aligned with a lifting chain of the crane such that the lifting loop is guided to automatically couple with said first member;

iv) securing the lifting loop to the lifting device; and v) operating the crane to raise the load.

* * * * *